United States Patent [19]

Berry et al.

[11] B 3,982,173

[45] Sept. 21, 1976

[54] AC-DC VOLTAGE REGULATOR

[75] Inventors: Clyde Raymond Berry, Goleta; Robert J. Cinzori, Santa Barbara, both of Calif.

[73] Assignee: Hughes Aircraft Company, Culver City, Calif.

[22] Filed: Apr. 10, 1974

[21] Appl. No.: 459,811

[44] Published under the second Trial Voluntary Protest Program on January 20, 1976 as document No. B 459,811.

[52] U.S. Cl. ..... 323/17; 321/18; 323/20; 323/22 T; 317/33 VR

[51] Int. Cl.[2] ..... G05F 1/56; G05F 1/64

[58] Field of Search ..... 323/20, 22 T, 17, DIG. 1, 323/22 SC; 321/16, 18; 317/33 VR

[56] References Cited

UNITED STATES PATENTS

| | | | |
|---|---|---|---|
| 3,323,034 | 5/1967 | Dubin et al. | 321/16 |
| 3,336,524 | 8/1967 | Healey | 323/22 SC |
| 3,437,912 | 4/1969 | Morris | 323/DIG. 1 |
| 3,505,583 | 4/1970 | Burkhardt et al. | 323/22 T |
| 3,711,761 | 1/1973 | Watson | 323/22 SC |
| 3,790,879 | 2/1974 | Milovancevic | 323/22 T |
| 3,796,919 | 3/1974 | Johnson | 323/20 |
| 3,809,999 | 5/1974 | Smith | 323/17 |

*Primary Examiner*—Gerald Goldberg
*Attorney, Agent, or Firm*—William J. Bethurum; W. H. MacAllister

[57] ABSTRACT

AC-DC voltage regulation is achieved utilizing, among other components, a series pass control element which is serially connected to a detector and filter output stage and between circuit input terminals and an output load. A rectified input voltage is applied to the series pass control element which controls the required amount of current flowing into a load every ½ cycle of the input signal. This current is, in turn, detected and filtered to provide the regulated DC output voltage. A voltage sensor is connected to the output of the series pass control element and in parallel with the detector and filter stage; this sensor breaks down at a predetermined level of series pass voltage to, in turn, generate a feedback control voltage. This control voltage is fed back to a current controlled switch which is connected in shunt with the series pass control element. This current controlled switch responds to the feedback voltage to accordingly limit the current conduction in the series pass control element to precisely the amount required by a varying load connected to the circuit output terminal. Thus, voltage regulation is achieved with a maximum AC-DC conversion efficiency and a minimum power dissipation.

9 Claims, 4 Drawing Figures

AC-DC VOLTAGE REGULATOR

FIELD OF THE INVENTION

This invention relates generally to AC-DC voltage regulators and more particularly to a highly efficient and frequency-independent AC-DC voltage regulator. This regulator may be designed to operate over a wide range of input frequencies, waveforms, and RMS voltages at a maximum AC-DC conversion efficiency and with a minimum power dissipation.

BACKGROUND

The field of power supply voltage regulation and particularly the field of AC-DC voltage regulation are both generally well-known and include many hundreds and perhaps thousands of different circuit approaches for converting an unregulated AC input voltage to a regulated DC output voltage. Many such regulator circuits may be found, for example, in class 321, subclass 18 of the United States Patent Office search files. These regulator circuits have a wide variety of applications ranging from communication systems to various motor vechile voltage regulator systems.

In some types of AC-DC voltage regulator applications, it is desirable to perform the voltage regulation function at the highest possible conversion efficiency, thus minimizing the heat dissipation within the regulator circuit. Such performance is obviously desirable from the standpoint of extending not only the lifetime of the electrical components in the voltage regulator circuit, but also the lifetime of other heat sensitive components and/or packaging material located nearby. Furthermore, such performance tends to minimize the overall size of the voltage regulator package.

PRIOR ART

As regards the prior art known to us which is generally related to our invention, these AC-DC voltage regulators typically include an input coupling transformer followed by an AC-DC rectifier stage (which may be half wave or full wave). A series pass control device with suitable current gain is typically connected to the output of the rectifier stage, and this control device provides an output current which is usually further modified in some way before being applied to an output load circuit. Such regulator circuits frequently include other voltage control features, such as DC voltage sensors for regulating the DC output voltage, or sophisticated filtering techniques for removing or minimizing the ripple voltage or current at various nodes in the circuit. However, none of the prior art AC-DC regulator circuits known to us provide a means for precisely and efficiently controlling the conduction of a series pass control element in accordance with the circuit's output load demands. Furthermore, the transformer input coupling normally used in these prior art circuits render them both frequency and RMS voltage dependent. This feature prevents such circuits from being used equally well with, say, 60 Hz AC household outlets and 400 Hz power available in certain aircraft. Additionally, this feature prevents these circuits from being used equally well with 110 volt and 220 volt AC power supplies.

BRIEF SUMMARY

The general purpose of our invention is to provide a frequency-independent, waveform-independent and RMS voltage-independent AC-DC voltage regulator in which the precise and efficient control of current conduction in a series pass control element is achieved, thereby minimizing heat dissipation in the circuit. Our circuit possesses most, if not all, of the advantages of related prior art AC-DC voltage regulators while possessing none of their aforementioned significant disadvantages. To attain this purpose, we have developed an AC-DC voltage regulator in which voltage regulation is achieved utilizing, among other things, a series pass control element serially connected to a detector and filter output stage. A rectified input voltage is converted every ½ cycle to a switched current by the series pass control element, and this current is detected and filtered to provide a desired level of DC output voltage in accordance with load demands on the circuit. A voltage sensing stage is connected to the output of the series pass control element and also in parallel with the detector and filter stage. This voltage sensing stage breaks down at predetermined levels of voltage thereacross and, in turn, generates a feedback control voltage. This control voltage is applied to a current controlled switch which is connected in shunt with the series pass control element. The current controlled switch is responsive to the feedback control voltage to limit the conduction in the series pass control element to precisely the amount required by the varying load demand on the circuit. Thus, this efficient control of conduction in the series pass control element insures a maximum AC-DC conversion efficiency and minimum power and heat dissipation within the circuit.

Accordingly, it is an object of the present invention to provide a new and improved highly efficient AC-DC voltage regulator circuit characterized by a minimum of heat dissipation during its operation.

Another object is to provide an AC-DC regulator of the type described which is operative in response to a wide range of input frequencies and input RMS voltage levels.

Another object is to provide a regulator of the type described which is capable of regulating voltages with all shapes of waveforms, including square waves, sine waves, triangular-shaped waves, etcetera.

A further object is to provide an AC-DC regulator of the type described which does not require coupling transformers and which may easily be constructed utilizing a relatively small number of standard off-the-shelf electronic components.

Another object is to provide an AC-DC voltage regulator which lends itself to certain add-on circuit design, including over-current and over-voltage protection, required for highly sophisticated regulator applications.

These objects are achieved in accordance with the circuit features which have been briefly summarized above and which will be described in further detail with reference to the accompanying drawings.

DRAWINGS

DETAILED DESCRIPTION

Figure 1:
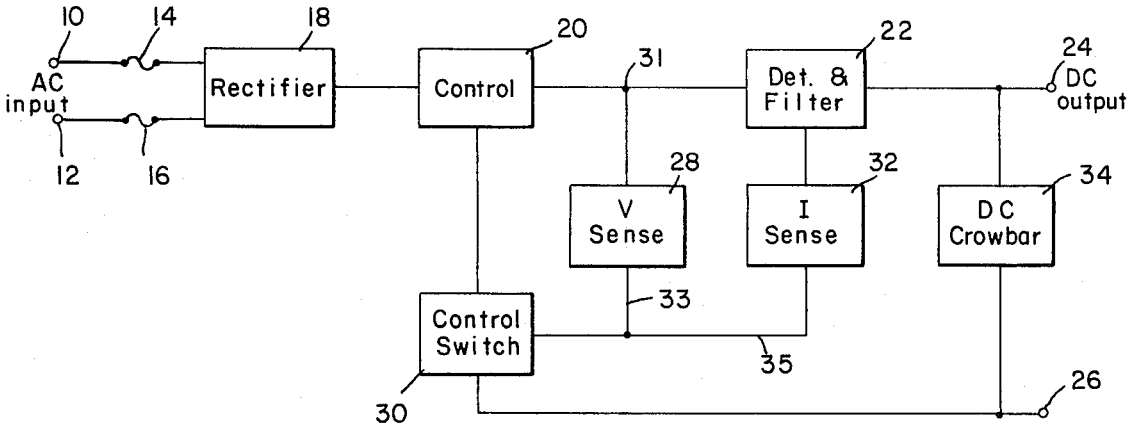
FIG. 1 is a functional block diagram of the voltage regulator embodying the present invention.

Referring now to FIG. 1, there is shown an AC-DC voltage regulator which includes AC voltage input terminals 10 and 12 to which are connected a pair of fuses 14 and 16. These fuses are, in turn, connected to the inputs of a full wave rectifier 18, which may be a conventional four diode bridge rectifier of the type shown in FIG. 2. The rectifier 18 is not necessarily limited to the full wave construction, and may instead be a half wave rectifier. The output of the rectifier 18 is DC coupled to the input of a series pass control element 20, and the conduction time of the control element 20 determines the current, voltage, and power delivered to a variable load (not shown). The output voltage from the control element 20 is detected and filtered in the network 22 which provides the regulated DC output voltage at terminal 24. Advantageously, the control element 20 includes a series pass transistor connected so its emitter-collector path is in series between the rectifier 18 and the detector and filter network 22.

A voltage sensing network 28 is connected as shown between one side of the control element 20 and the gate electrode of a current controlled switch 20. When a predetermined pulse voltage is exceeded at node 31, a corresponding control voltage is developed in the voltage sensing network 28 and is applied by way of line 33 to the gate electrode of the current controlled switch 30. This closed loop voltage feedback control turns on the switch 30, and the rectified voltage at node B (see FIG. 2) causes the switch 30 to turn off when this voltage goes to zero every ½ cycle of AC input voltage. This, in turn, controls the duty cycle of the series pass control element 20.

The AC-DC regulator system shown in FIG. 1 includes over-current and over-voltage protection networks 32 and 34 respectively. The current sensing network 32 is connected between the detector and filter stage 22 and the gate of switch 30 and detects surge currents above a predetermined level to generate another control signal. This latter signal is applied via line 35 to the control electrode of switch 30 in the event that a high initial surge current above an acceptable level charges the detector and filter network 22. This sometimes occurs during initial turn-on of the regulator circuit. A so-called DC crowbar network 34 is connected as shown across the output terminals 24 and 26 and responds to excessively high voltages to short the output terminals 24 and 26 and activate the fuses 14 and 16, thus protecting any external loads driven by the power supply.

As more current is demanded by the load connected to the terminals 24 and 26, the voltage sensing stage 28 begins to generate a turn-on control voltage for the switch 30 later in each on-off cycle of conduction for the series pass control stage 20. In this manner, the switch 30 remains non-conducting for a longer portion of each cycle of rectified voltage applied to the control stage 20. Thus, with increasing load currents, the control element 20 is maintained in conduction for longer periods of time as a direct result of this increased load current. When the output load current demands decrease, the action of the peak detector and filter 22 react to bring the voltage across the voltage sensor 28 up to a predetermined threshold level earlier in each cycle of input voltage. Thus, the SCR switch 30 is biased to conduction earlier in each input cycle and serves as a bypass for the base drive to the control element 20 for a larger portion of the cycle of conduction for the control stage 20. Therefore, the regulator described in FIG. 1 operates such that its series pass control element 20 is turned on only for the time necessary to deliver the required amount of current to a variable output load.

Figure 2:
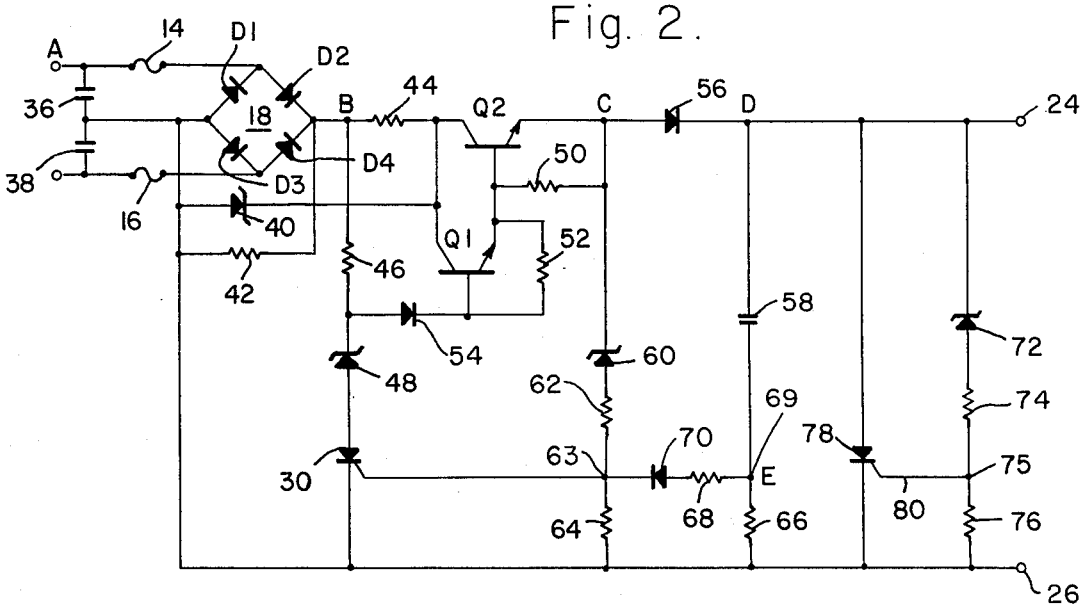
FIG. 2 is a schematic circuit diagram of a preferred embodiment of the invention, with the various stages therein corresponding to the functional stages in FIG. 1.
Figure 3:
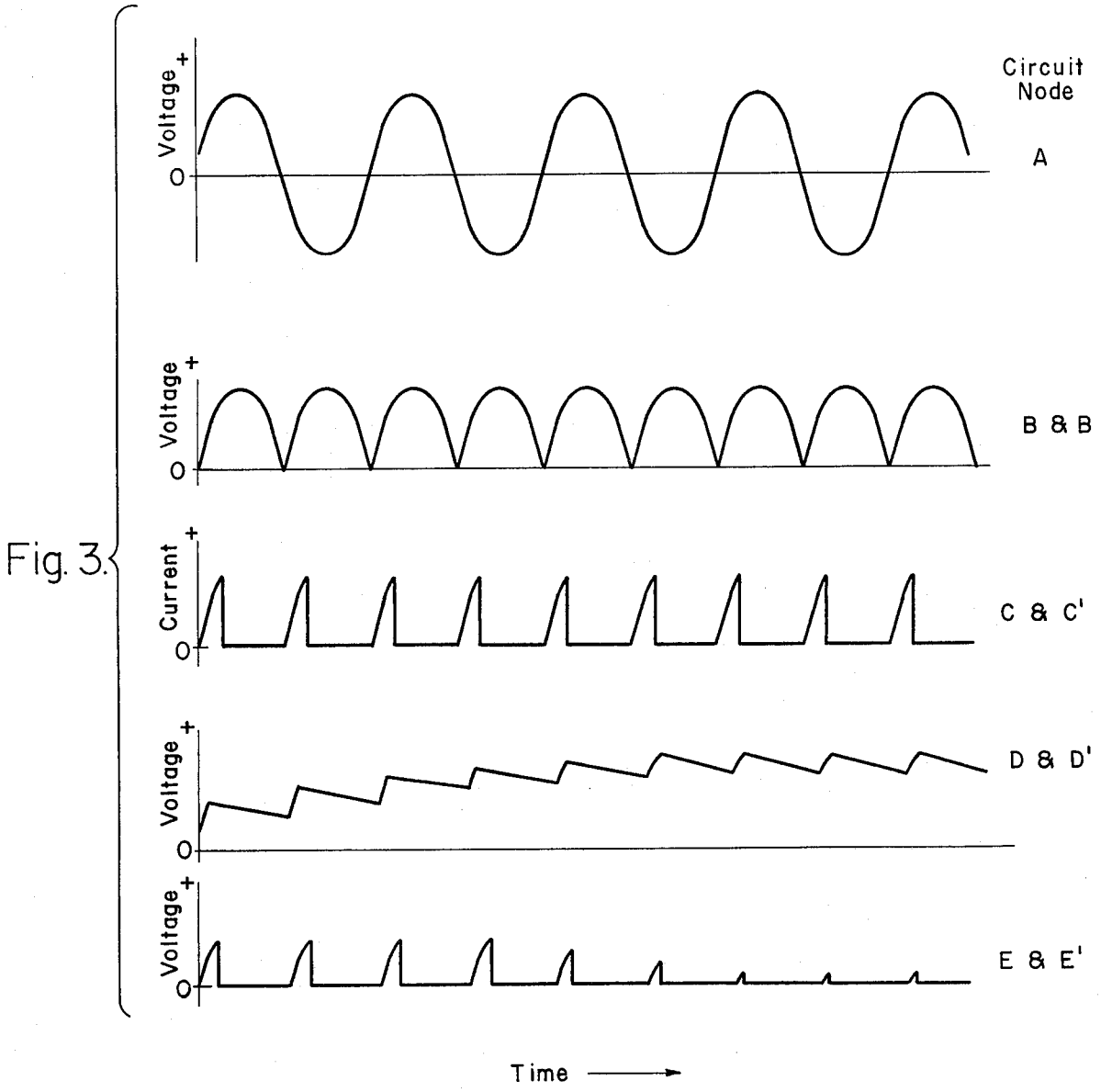
FIG. 3 illustrates the voltage and current waveforms as they appear at various circuit points referenced A, B, C, D, etc., in FIG. 2.

Referring now to FIGS. 2 and 3, the functional blocks identified as 18, 20, 22, 28, 30, 32 and 34 correspond to the functional blocks in FIG. 1 with identical numbers. The specific components included within these functional stages, as well as the other circuit components which add to the sophistication of the circuit in FIG. 2, will also be identified.

The AC input voltage in FIG. 3A to be rectified is received at the input terminals 10 and 12 across which are connected a pair of filter capacitors 36 and 38 which serve to suppress any noise on the input AC line. The filtered AC line voltage is coupled through the previously identified fuses 14 and 16 and is rectified by the diode bridge rectifiers D1, D2, D3 and D4, so that a full wave rectified voltage appears at node B as shown in FIG. 3B below. This voltage is converted into a current by the series input current limiting resistor 44 at the collector of the Darlington connected transistor Q2. A zener diode 40 is connected between the collector of Q2 and the system ground 26 and serves to protect transistors Q1 and Q2 by limiting the amplitude of any switching transients or spikes that may appear at the collectors of Q1 or Q2 when the two control devices Q1 and Q2 are turned off. The resistor 42 which is connected across the diode bridge 18 allows the voltage at node B to drop below the voltage which appears across components 46, 48 and 30 to be further described.

The zener diode 48 is connected as shown in series with a current limiting resistor 46 and between node B and the anode of the silicon control rectifier (SCR) 30. These components 30, 46 and 48 comprise a first shunt path for diverting input current from the Darlington connected transistors Q1 and Q2, as will be further described. Each of the Darlington connected transistors Q1 and Q2 includes base pull down resistors 52 and 50, respectively, and a protection diode 54 is connected between resistor 46 and the base of transistor Q1 in order to prevent the breakdown of the emitter-to-base junctions of transistors Q1 and Q2 when a positive going voltage is applied to the emitters of these two transistors.

The full wave rectified voltage at node B is transformed into a succession of current pulses (FIG. 3C) at node C by the operation of the Darlington control stage 20. These current pulses at node C are then peak detected and filtered by the operation of the series diode detector 56 and the filter capacitor 58, which together provide a DC ripple voltage at point D as shown in FIG. 3D.

The previously identified voltage sensor 28 comprises a second or output shunt path for the Darlington stage 20 and includes a zener diode 60 connected in series with voltage divider resistors 62 and 64 as shown. Node 63 is at ground potential until such time that the zener diode 60 threshold voltage is exceeded. At this time, the zener diode 60 is biased to reverse breakdown, whereupon the voltage at point 63 begins to rise as turn-on gate current is provided for the current controlled switch 30. When the current controlled switch 30 turns on, then current begins to flow in the shunt path comprising resistor 46, zener diode 48 and the switch 30.

This action serves to rob the transistor Q1 in the Darlington stage 20 of base drive, thereby simultaneously turning off transistors Q1 and Q2. Therefore, the next effect of the voltage at node C exceeding a predetermined threshold level is that the current controlled switch 30 turns on to, in turn, drive transistors Q1 and Q2 to non-conduction. This, in turn, reduces the voltage at node C by reducing the charging current per unit time flowing into capacitor 58. This close loop feedback control insures that the voltages at nodes C and D are maintained substantially constant while simultaneously providing the required current demands to an external load connected to the output terminals 24 and 26. Thus, if the current demands at the output terminals 24 and 26 increase to thereby require additional output current from node D (or a net reduction in charging current for capacitor 58), then the voltage at node C will be correspondingly reduced to, in turn, produce a corresponding increase in the conduction times or duty cycle for the Darlington connected transistors Q1 and Q2.

The current sensor stage 32 comprising resistors 66 and 68 and diode 70 is for the purpose of insuring that excessive initial instantaneous surges of current into capacitor C1 do not burn out the series pass transistors Q1, Q2 and capacitor 58. Thus, if an initial surge of charging current into capacitor 58 exceeds a chosen value, a corresponding increase in voltage at node 69 is coupled through resistor 68 and diode 70 to the gate of the SCR 30. This closed loop control action turns on SCR 30 to simultaneously turn off transistors Q1 and Q2 and insure that these transistors and capacitor 58 are not burned out by this initial surge of current.

Finally, the circuitry in FIG. 2 includes a so-called "crowbar" voltage protection stage 30 including a zener diode 72 and voltage divider resistors 74 and 76 connected as shown across the output terminal 24 and 26. This crowbar stage further includes an SCR 78 having its gate electrode 80 connected to the midpoint 75 of resistors 74 and 76. When the voltage across the output terminals 24 and 26 exceeds the threshold voltage of the DC bias string 72, 74 and 76, the zener diode 72 breaks down, and provides turn-on gate current for the SCR 78. When the SCR 78 is turned on by this over-voltage condition, there is an effective short circuit condition produced across the output terminals 24 and 26. And, the short circuit current produced by this condition causes the fuses 14 and 16 in the input circuitry to be activated and thus protect any additional circuitry which may be connected to the output terminals 24 and 26.

Referring now to FIG. 3B, the rectified voltage shown therein varies as a rectified sine wave which is converted to a succession of current pulses as shown in FIG. 3C. These current pulses at node C are converted to the DC voltage waveform in FIG. 3D by the peak detector and filter stage 22. The peak amplitude of this DC voltage waveform is controlled by the breakdown voltage of the zener diode 60, and the voltage level $V_D$ at node D may be expressed as:

$$V_D = V_{60} + V_{63}\left[\frac{R_{62} + R_{64}}{R_{64}}\right] - V_{56} \qquad \text{(Equation 1)}$$

where $V_D$ = DC voltage at node D, $V_{60}$ = Zener Voltage of zener diode 60, $V_{63}$ = Gate to Cathode Voltage of SCR 30 and $V_{56}$ is the forward voltage across detector 56.

The zener diode 48 is selected to have a breakdown voltage much less than the desired DC voltage at the output node D, the latter typically on the order of 20 volts. When the zener diode 48 stops conducting as the rectified voltage at node B approaches zero, there is not sufficient holding current into the SCR 30 to maintain conduction therein. The SCR 30 will, therefore, turn off and remain off until triggered into conduction the next half cycle by the next breakdown of the zener diode 60.

Both the maximum ripple current and the peak turn-on current into capacitor 58 are controlled by sensing the voltage drop across resistor 66. When the voltage drop across resistor 66 exceeds the voltage required to overcome the $V_{BE}$ of diode 70 and turn on the SCR 30, the base drive to transistor Q1 is shunted through resistor 46 and diode 48 to the SCR 30. As previously mentioned, the diode 54 prevents the breakdown of the emitter-to-base junction of transistors Q1 and Q2 by a positive going voltage at the emitter of Q2.

The peak current $I_{PK}$ in capacitor 58 is limited to a value expressed by the relation $$I_{PK} = \frac{1}{R_{66}}\left(V_{63} \cdot \frac{R_{64} + R_{68}}{R_{64}} + V_{70}\right) \qquad \text{(Equation 2)}$$

where $I_{PK}$ = Peak Current in 58, and $V_{70}$ =

Forward Voltage Across diode 70. The letter "R" followed by a reference number denotes, of course, the ohmic value of the particular resistor designated with that particular number in the accompanying drawing.

The maximum voltage for the DC waveform in FIG. 3D may be expressed as $$V_{D\,max} = V_{75} \cdot \frac{R_{74} + R_{76}}{R_{76}} + V_{72} \qquad \text{(Equation 3)}$$

where $V_{75}$ = Gate to Cathode Voltage of SCR 78, and $V_{72}$ = Zener Voltage of diode 72.

Figure 4:
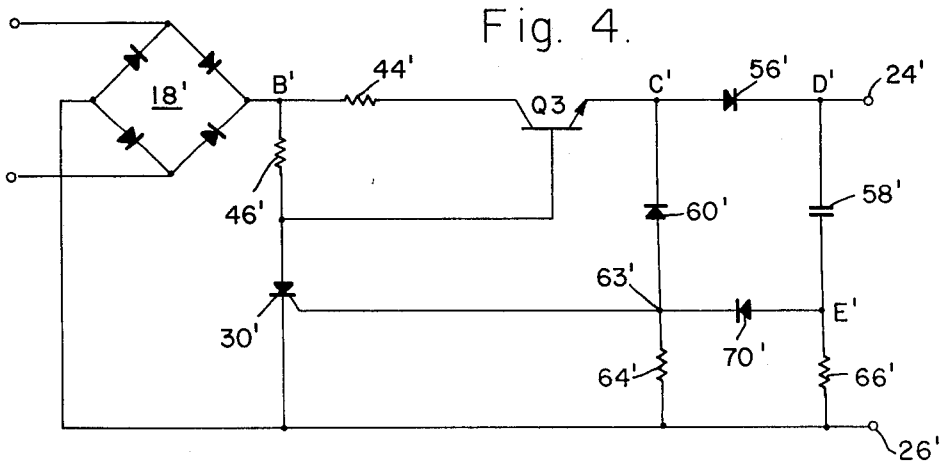
FIG. 4 is an alternative and simplified circuit embodiment of the invention.

Referring now to FIG. 4, there is shown an alternative circuit approach for practicing the present invention. This circuitry includes a single high voltage series pass transistor Q3 having a collector current limiting resistor 44' and a base current limiting resistor 46' connected thereto as shown from one output node B' of the rectifier 18'. The resistor 46' and SCR 30' are serially connected in the input shunt path for the series pass transistor Q3.

The second or voltage sensor shunt path of the circuit includes, respectively, a zener diode 60' and series resistor 64' connected thereto which coat to develop a turn-on voltage at node 63' for turning on the SCR 30' when the voltage at point C' exceeds a predetermined value. The rectifier 56' and the filter capacitor 58' provide the peak detection and filtering action corresponding to that previously described with respect to stage 22 in FIG. 2 above. Thus, as the load current through the output load terminal 24' increases to thereby reduce the voltages at points C' and D' respectively, the zener diode 60' will be biased to reverse breakdown at a later point in each cycle of the AC input voltage. This action, in turn, will cause NPN transistor Q3 to be maintained in conduction for a longer portion of each cycle of AC input voltage applied to the bridge 18'. This action will cause the NPN transistor Q3 to deliver the required amount of current to the load, while simultaneously maintaining a substantially constant output voltage at point D'. As the load current demands decrease, then the voltage at point C' will begin to exceed its threshold value earlier in each cycle of input voltage. Such action will turn on SCR 30' at an earlier point in each cycle of AC input voltage and thereby reduce the total conduction time of the NPN transistor Q3 in a manner identical to that described above with reference to the series pass control stage 20 in FIG. 2.

What is claimed is:

1. An efficient voltage regulation network for converting an unregulated AC input voltage into a regulated DC output voltage across a load, said network comprising:

a. a series pass control element for conducting current a given portion of each cycle of AC input voltage coupled thereto, b. means connected to the output of said control element for detecting and filtering the output voltage thereof and providing a DC ripple voltage, said detection means disconnecting said control element from said load once each cycle of AC input voltage applied to said control element and preventing said control element from turning on more than one each cycle of AC input voltage applied thereto, c. means connected to the output of said control element for sensing the changes in voltage thereat and for generating a control potential at a control node, and d. means coupled between said control node and the input of said series pass control element and responsive to the voltage generated at control node for controlling the time during each cycle of AC input voltage that said series pass control element is conducting current to an output load, whereby said control element provides the required amount of output current for a varying load on said regulator and the latter, in turn, determines the varying level of voltage at the output of said series pass control element.

2. The circuitry defined in claim 1 wherein said series pass control element includes a Darlington transistor pair connection with one transistor thereof having its emitter-collector path connected in series between input and output terminals of said network and having the base of the other transistor in said pair coupled to and controlled by said voltage responsive means.

3. The circuitry defined in claim 1 wherein said detecting and filtering means includes a diode detector and filter capcitor connected to the output of said series pass control element for providing a regulated DC voltage across said filter capacitor and a varying DC voltage across said voltage sensing means at the output of said series pass control element.

4. Circuitry defined in claim 1 wherein said voltage responsive means includes a silicon controlled rectifier having a gate electrode thereof connected to said control node of said voltage sensing means and responsive to a control voltage resulting from varying load conditions to become biased to conduction to divert current from said series pass control element during a continuously variable portion of each cycle of AC input voltage.

5. Circuitry defined in claim 1 which includes a full wave bridge rectifier coupled between a pair of regulator circuit input terminals and said series pass control element for providing a full wave rectified voltage at the input of said series pass control element and across said voltage responsive means, whereby said voltage responsive means is operative to conduct current from said full wave bridge rectifier and through said voltage responsive means when the latter is biased conductive by a voltage generated at said control node of said voltage sensing means.

6. Circuitry defined in claim 1 which further includes current sensing means coupled between said detection and filtering means and said voltage responsive means for generating thereat a voltage sufficient to turn on said voltage responsive means when the current through said detection and filtering means reaches a critical level, thereby causing said voltage responsive means to turn off said series pass control element and prevent the latter from overcurrent damage by peak current surges in said regulator.

7. Circuitry defined in claim 1 which further includes over-voltage protection means connected across the output terminals of said regulator and including:

a. a voltage sensor connected across said output terminals, and b. a gate controlled rectifier connected to said voltage sensor and operative to become conductive when the voltage across said output terminals exceeds a pre-established threshold level, whereby said gate controlled rectifier is operative to activate fuses at the inputs of said regulator and prevent damage to any external circuitry coupled to the output thereof.

8. Circuitry defined in claim 1 wherein said voltage sensing means includes a serially connected zener diode and voltage divider network connected in shunt with the output of said series pass control element for developing a control voltage at said control node with said voltage divider network, and b. said voltage responsive means includes a gate controlled rectifier serially connected to yet another zener diode and a current limiting resistor and in shunt with the input of said series pass control element, whereby said gate controlled rectifier is turned on to divert current from said series pass control element for a continuously variable fraction of each cycle of AC voltage applied to said regulator.

9. Circuitry defined in claim 6 wherein said current sensing means includes:

a. a resistor connected in series with said filtering means for developing a voltage thereacross, and b. a diode connected between said last named resistor and the gate of said gate controlled rectifier for driving the latter to conduction during peak current surges through said filtering means.

* * * * *